US008578955B1

(12) United States Patent
Rothbaum

(10) Patent No.: US 8,578,955 B1
(45) Date of Patent: Nov. 12, 2013

(54) CANOPY SYSTEM

(71) Applicant: Scott David Rothbaum, North Merrick, NY (US)

(72) Inventor: Scott David Rothbaum, North Merrick, NY (US)

( * ) Notice: Subject to any disclaimer, the term of this patent is extended or adjusted under 35 U.S.C. 154(b) by 0 days.

(21) Appl. No.: 13/651,858

(22) Filed: Oct. 15, 2012

(51) Int. Cl.
*A45B 25/02* (2006.01)

(52) U.S. Cl.
USPC ..... 135/15.1; 135/16

(58) Field of Classification Search
USPC ..... 135/15.1, 16
See application file for complete search history.

(56) References Cited

U.S. PATENT DOCUMENTS

| | | | | |
|---|---|---|---|---|
| 433,277 | A * | 7/1890 | Delavigne | 108/128 |
| 5,347,667 | A * | 9/1994 | Schwarz et al. | 5/418 |
| 5,884,645 | A * | 3/1999 | Chen et al. | 135/25.1 |
| 5,899,571 | A * | 5/1999 | Chalk | 383/4 |
| 6,502,257 | B1 * | 1/2003 | Glenn | 5/418 |
| 2002/0036008 | A1 * | 3/2002 | Hickam et al. | 135/98 |
| 2002/0185167 | A1 * | 12/2002 | Lin et al. | 135/16 |

* cited by examiner

*Primary Examiner* — David Dunn
*Assistant Examiner* — Danielle Jackson
(74) *Attorney, Agent, or Firm* — Scully, Scott, Murphy & Presser, P.C.

(57) ABSTRACT

The present application is directed towards a canopy system. The canopy system includes a canopy that is operably connected to a post and a base that is also operably connected to the same post.

19 Claims, 3 Drawing Sheets

CANOPY SYSTEM

FIELD OF THE DISCLOSURE

The disclosure relates generally to the field of canopies. More specifically, the present disclosure is directed to canopy base systems that aid in the ease of maintaining a canopy in one location.

BACKGROUND OF THE DISCLOSURE

Many canopies, including umbrellas and beach umbrellas, are difficult to keep in place since they are portable and must be set up at various locations. Many umbrellas require a user to push or pound a spiked pole into the ground, while some other umbrellas require the user to screw the base of the pole into the ground. Both of these options present many disadvantages, including a reliance on the physical strength and ability of the user and a reliance on the softness of the ground the pole is being placed into.

What is desired is a canopy system that overcomes the disadvantages of prior canopies by not relying on the ability of a user to force a pole into the ground.

Embodiments of the present application provide a system that addresses the above and other issues.

SUMMARY OF THE DISCLOSURE

The system of the present application is directed towards canopies. This canopy system includes a canopy that is operably attached to a post and a base that is also operably attached to the post.

BRIEF DESCRIPTION OF THE DRAWINGS

The present disclosure will be better understood by reference to the following drawings of which.

DETAILED DESCRIPTION

Figure 1:
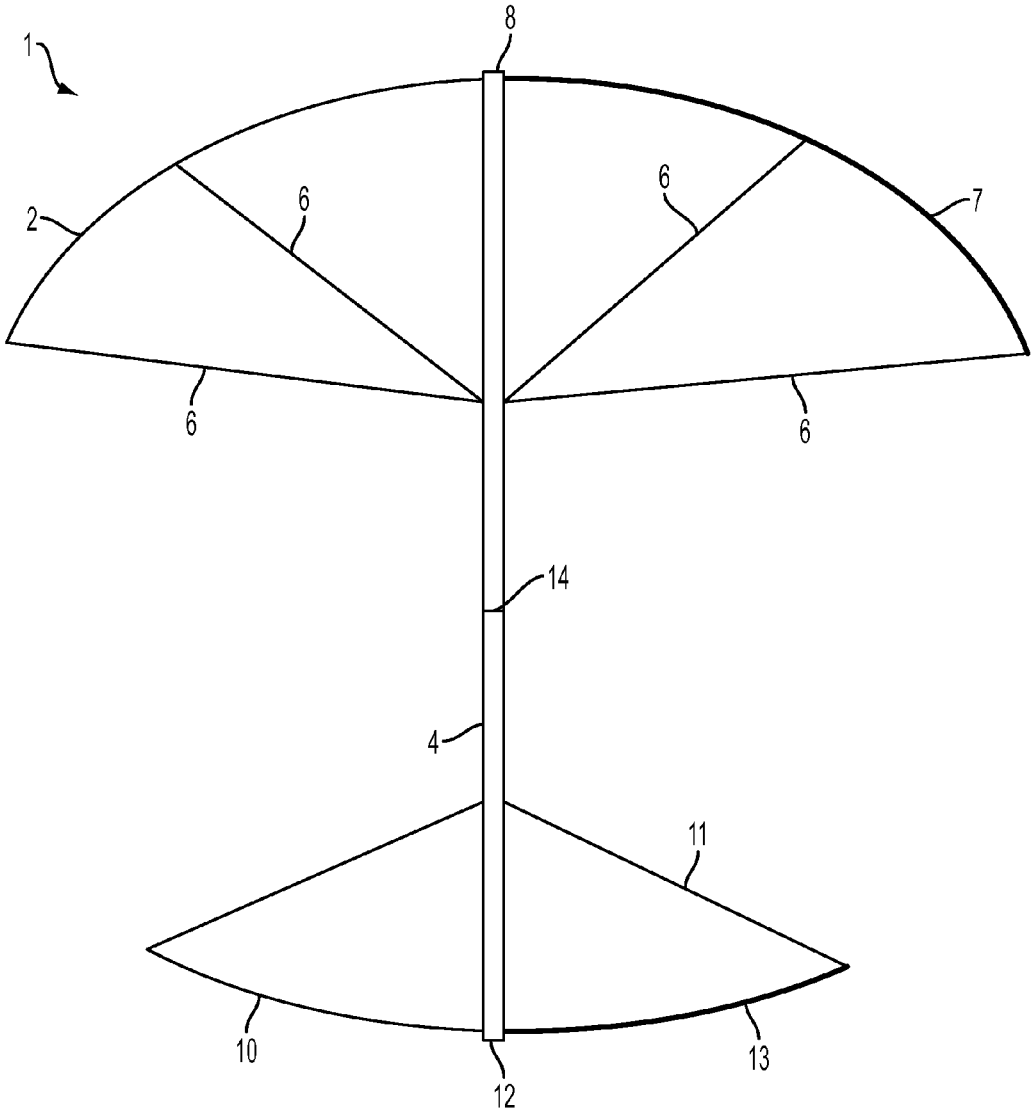
FIG. 1 is a vertical cross section of the canopy system.

The present application is directed towards a canopy system 1, as illustrated in FIG. 1. FIG. 1 illustrates a vertical cross section of canopy system 1. The canopy system 1 includes a canopy 2 operably attached to a post 4, adjacent to a first end 8 of post 4, canopy 2 extending a distance radially from post 4. Post 4 can be telescoping and can also be moderately flexible along its length or in a region of post 4.

The term "canopy" is meant to mean any covering of a material of any suitable shape and suitable size to create shade or protection from environmental conditions. Canopy 2 can be made of any suitable material including but not limited to plastic, woven material, including fabrics, and metal. The suitable shape of canopy 2 includes but is not limited to circular, oval, square, rectangular, quadrilateral, triangular or a shape with an eccentric or custom designed shape. Canopy 2 can also be concave with respect to post 4, convex with respect to post 4 or can be substantially perpendicular to post 4.

The system can also include a plurality of supports 6 that extend from post 4, a distance away from first end 8, to a portion of canopy 2. The plurality of supports 6 can contact and be operably connected to canopy 2 at any suitable location, such as along the periphery of canopy 2. Canopy 2 can also include a reinforcing support 7 to support canopy 2 in an open position. Reinforcing support 7 is operably connected to post 4 at a distance adjacent to first end 8. Although only one reinforcing support 7 is shown, the present system can include a plurality of reinforcing supports. Each of supports 6 and reinforcing supports 7 can include a hinge, so that canopy 2 can be expanded from and collapsible to post 4. In one embodiment, the hinge can lock and unlock so that canopy 2 can both maintain an expanded state but then subsequently be collapsed. In another embodiment, a portion of supports 6 and reinforcing supports 7 can slide along a channel in post 4, sliding towards second end 12 when canopy 2 is collapsing to post 4 and sliding towards first end 8 when expanding from post 4. In this sliding embodiment, once the portion of supports 6 and reinforcing supports 7 reach a desired location causing canopy 2 to be in an expanded state, the portion can be secured so that canopy 2 maintains this expanded state. To collapse canopy 2, supports 6 and reinforcing supports 7 can be unsecured.

Post 4 can be a one continuous piece, or it may be two or more posts that can be joined by a separation mechanism 14. Separation mechanism 14 can be any suitable mechanism that can maintain a connection between two sections of post 4 and can also be disengaged to remove the two sections of post 4 from each other. Examples of separation mechanism could include a male thread on one portion of post 4 and a female thread on a second portion of post 4. Another example of a separation mechanism could include the portion of post 4 that is operably attached to canopy 2 sliding into the portion of post 4 that is operably attached to base 10. A structure surrounding the portion of post 4 that is operably attached to base 10 could then be tightened, thereby squeezing and holding the portion of post 4 that is operably attached to canopy 2.

The system also includes a base 10 that is operably attached to post 4, a distance adjacent to a second end 12 of post 4. Base 10 extends a distance radially from post 4. Post 4 can be separable from base 10 so that the components can be separated for transport, storage, etc.

The term "base" is meant to mean any material of any suitable shape and suitable size to accept and hold a material that is to be placed on it. Base 10 can be made of any suitable material including but not limited to plastic, woven material, including fabrics, and metal. The base can also be made of a porous material. The suitable shape of base 10 includes but is not limited to circular, oval, square, rectangular, quadrilateral, triangular or a shape with an eccentric or custom designed shape. Base 10 can also have any suitable curvature, and can be concave with respect to post 4, convex with respect to post 4 or can be substantially perpendicular to post 4.

The system can also include a plurality of base supports 11 that extend from post 4, a distance away from second end 12, to a portion of base 10. The plurality of base supports 11 can contact and be operably connected to base 10 at any suitable location, such as along the periphery of base 10. Base 10 can also include a base reinforcing support 13 to support base 10 in an open position. Base reinforcing support 13 is operably connected to post 4 at a distance adjacent to second end 12. Although only one base reinforcing support 13 is shown, the present system can include a plurality of base reinforcing supports.

Base 10 can be collapsible towards post 4, so that the periphery of base 10 is brought near post 4 or in contact with post 4, and expandable away from post 4, so that the periphery of base 10 is brought a distance away from post 4.

Each of base supports 11 and base reinforcing supports 13 can include a hinge, so that base 10 can be expanded from and collapsible to post 4. In one embodiment, the hinge can lock and unlock so that base 10 can both maintain an expanded state but then subsequently be collapsed. In another embodiment, a portion of base supports 11 and base reinforcing supports 13 can slide along a channel in post 4, sliding towards first end 8 when base 10 is collapsing to post 4 and sliding towards second end 12 when expanding from post 4. In this sliding embodiment, once the portion of base supports 11 and base reinforcing supports 13 reach a desired location causing base 10 to be in an expanded state, the portion can be secured so that base 10 maintains this expanded state. To collapse base 10, base supports 11 and base reinforcing supports 13 can be unsecured.

The suitable shape of base 10 can be any shape and size, and can have a surface area greater than about 10% of the surface area of canopy 2. Base 10 can also have a larger surface area, about 15%, about 20%, about 25%, about 30%, about 35%, about 40%, about 45%, about 50%, about 55%, about 60%, about 65%, about 70%, about 75%, about 80%, about 85%, about 90%, about 95% or about 100% greater or more than the surface area of canopy 2.

Base 10 is configured to support a mass of material that can be added on top of base 10. The material can be any suitable material, including but not limited to sand, soil, gravel, other loose material that have a particle size smaller than about one inch, and mixtures thereof. The material can be material that is present at the site of use of canopy system 1, such as if canopy system 1 was to be used on a beach, the material could be the sand present at the beach. Base 10 can be placed on the surface of the material to be added on top of base 10, or a portion of the material can be removed so that base 10 can be placed below the original surface of the material.

The mass to be added on top of base 10 can be in a sufficient amount to maintain canopy 2 and post 4 in one location. As one exemplary embodiment, the mass placed on top of base 10 can be about 50 pounds in weight. In other embodiments this weight can differ, and can be, for example, about 5 pounds, about 10 pounds, about 15 pounds, about 20 pounds, about 25 pounds, about 30 pounds, about 35 pounds, about 40 pounds, about 45 pounds, about 55 pounds, about 60 pounds, about 65 pounds, about 70 pounds, about 75 pounds, about 80 pounds, about 85 pounds, about 90 pounds, about 95 pounds, about 100 pounds or more.

Figure 2:
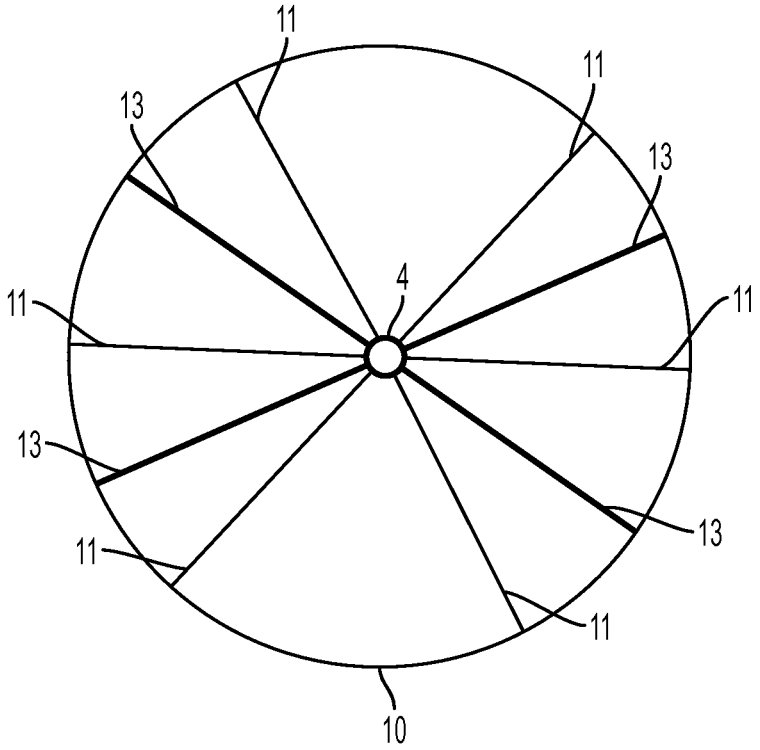
FIG. 2 is a horizontal cross section of the canopy system.

Turning now to FIG. 2, which is a horizontal cross section of post 4 below canopy 2, looking down towards base 10. In FIG. 2 base 10 is shown as being circular for illustration purposes, but base 10 can be any suitable shape. As can be seen, a plurality of base supports 11 as well as a number of base reinforcing supports 13 radiate from post 4 to operably connect to the periphery of base 10. Although base supports 11 and base reinforcing supports 13 are illustrated as contacting base 10 along its periphery, both base supports 11 and base reinforcing supports 13 can be shorter so as to contact and operably connect to base 10 inside its periphery.

Figure 3:
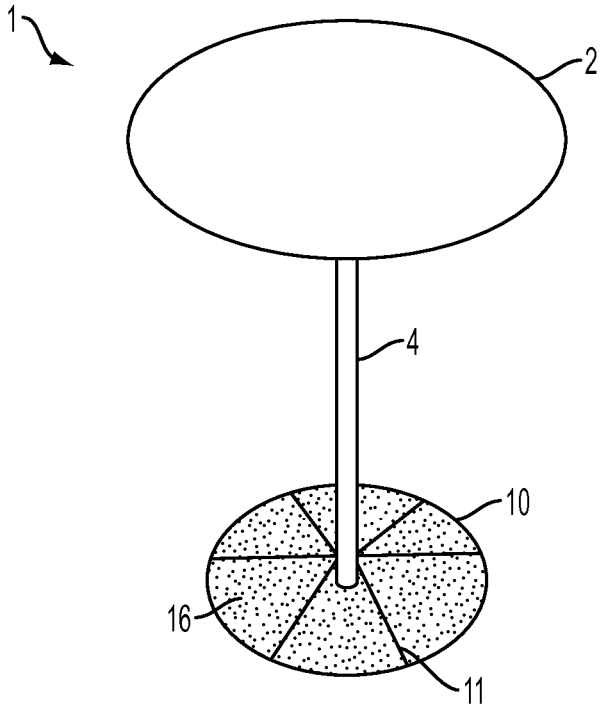
FIG. 3 is a top view of the canopy system.

Now referring to FIG. 3, a top view of canopy system 1 is illustrated. The top of canopy 2 is shown, for example, as being substantially circular. Base 10 is shown with a plurality of base supports 11 and is shown as substantially flat with material 16 placed on top of it. As an example, material 16 in this illustration is shown as sand.

Example 1

The following example describes one embodiment of the present disclosure. A user arrives at a beach and begins to set up canopy system 1. Initially, the user unfolds base 10, so that base 10 extends away from post 4, and base supports 11 and base reinforcing supports 13 are extended between base 10 and post 4. The user then places sand on top of base 10, covering base reinforcing supports 13 and the surface of base 10. The user places sand on top of base 10 by using a few scoops of sand by hand or by using a small shovel, and covers base 10 with sand from the area neighboring base 10. In this embodiment, base supports 11 are not covered by sand but in other embodiments, depending on design, base supports 11 can be covered.

In the present embodiment, post 4 is in two separable pieces, one attached to base 10, the other attached to canopy 2. Now that base 10 has sand on it, the user connects the top piece of post 4 to the bottom piece of post 4 through the use of separation mechanism 14 by sliding the top piece of post 4 into the bottom piece of post 4 and then tightening the structure on the bottom piece of post 4 to hold and secure the top piece of post 4 to the bottom piece of post 4. Now that post 4 is one connected member, canopy 2 is then extended to provide shade for the user.

In this embodiment, base 10 has a surface area of about 50% of the surface area of canopy 2.

Once the user decides to leave the beach, they first fold canopy 2 against post 4, and then remove the top portion of post 4 from the bottom portion of post 4 at separation mechanism 14 by loosening the structure on the bottom portion of post 4 and removing the top portion of post 4. The user then removes substantially all of the sand from the surface of base 10 by scooping or pushing the sand away from base 10. In this example, the material of base 10 is a porous, screen like, material such that any remaining sand can be passed through base 10 once it is lifted from the surface of the beach. Base 10 is then folded up so that it contacts post 4. The canopy system 1 is then in a relatively small volume for transport and reuse.

The described embodiments of the present disclosure are intended to be illustrative rather than restrictive, and are not intended to represent every embodiment of the present disclosure. Various modifications and variations can be made without departing from the spirit or scope of the disclosure as set forth in the following claims both literally and in equivalents recognized in law.

What is claimed is:

1. A canopy system, the system comprising:

a canopy operably attached to a post, adjacent to a first end of the post, the canopy extending a distance radially from the post; and a base operably attached to the post, adjacent to a second end of the post, wherein the base extends a distance radially from the post, wherein the base has a surface area greater than about 50% of the surface area of the canopy, a plurality of first supports extend from the post, a distance away from the second end of the post, to a peripheral edge of the base and a plurality of second supports extending from the end of the post to the peripheral edge of the base, wherein the second supports attach to the peripheral edge of the base at points between the first supports.

2. The system of claim 1, wherein the post is separable from the base.

3. The system of claim 1, wherein the post comprises two or more posts operably connected to each other.

4. The system of claim 1, wherein the base is concave with respect to the post.

5. The system of claim 1, wherein the base is convex with respect to the post.

6. The system of claim 1, wherein the base is substantially perpendicular to the post.

7. The system of claim 1, wherein the base has a surface area greater than about 70% of the surface area of the canopy.

8. The system of claim 1, wherein the base has a surface area greater than about 100% of the surface area of the canopy.

9. The system of claim 1, wherein a plurality of supports extend from the post, a distance away from the first end, to the canopy.

10. The system of claim 9, wherein the plurality of supports are affixed on one end to the post and affixed on the other end to the canopy.

11. The system of claim 1, wherein the base is collapsible towards the post.

12. The system of claim 1, wherein the base is expandable away from the post.

13. The system of claim 1, wherein the base is configured to support a mass of material.

14. The system of claim 13, wherein the mass is sufficient to maintain the canopy in one location.

15. The system of claim 13, wherein the mass is about 40 pounds.

16. The system of claim 13, wherein the material is selected from the group consisting of sand, soil, gravel and mixtures thereof.

17. The system of claim 1, wherein the base extends 360° radially from the post.

18. The system of claim 17, wherein the base extends 360° circularly from the post.

19. The system of claim 1, wherein the base comprises a top surface and a bottom surface, the top surface facing the canopy, the bottom surface opposite the top surface and wherein no portion of the canopy system extends beyond the bottom surface.

* * * * *